US006810682B1

(12) United States Patent
Schuchart et al.

(10) Patent No.: US 6,810,682 B1
(45) Date of Patent: Nov. 2, 2004

(54) REFRIGERATOR WITH INTERNAL WATER DISPENSER

(75) Inventors: Ryan D. Schuchart, Cedar Rapids, IA (US); Lester J. Ott, Swisher, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/441,103

(22) Filed: May 20, 2003

(51) Int. Cl.[7] ..... B67D 5/62
(52) U.S. Cl. ..... 62/98; 62/389; 222/146.6
(58) Field of Search ..... 62/98, 389; 222/146.6

(56) References Cited

U.S. PATENT DOCUMENTS

| | | | | |
|---|---|---|---|---|
| 2,982,114 | A | | 5/1961 | Cobb et al. |
| 4,739,629 | A | | 4/1988 | True |
| 5,135,645 | A | | 8/1992 | Sklenak et al. |
| 5,211,462 | A | | 5/1993 | Bien et al. |
| 5,315,845 | A | | 5/1994 | Lee |
| 5,357,769 | A | * | 10/1994 | Crabtree et al. ..... 62/441 |
| 5,490,547 | A | * | 2/1996 | Abadi et al. ..... 141/359 |
| 5,707,518 | A | | 1/1998 | Coates et al. |
| 5,715,699 | A | | 2/1998 | Coates et al. |
| 5,787,724 | A | | 8/1998 | Pohl et al. |
| 5,813,245 | A | | 9/1998 | Coates et al. |
| 5,907,958 | A | | 6/1999 | Coates et al. |
| 6,079,221 | A | | 6/2000 | Senner |
| 6,120,685 | A | | 9/2000 | Carlson et al. |
| 6,276,146 | B1 | | 8/2001 | Kim et al. |
| 6,303,031 | B1 | | 10/2001 | Senner |
| 6,337,015 | B1 | | 1/2002 | Poirier |
| 6,355,177 | B2 | | 3/2002 | Senner et al. |
| 6,375,834 | B1 | | 4/2002 | Guess et al. |
| 6,460,367 | B1 | | 10/2002 | DuHack |
| 2002/0189275 | A1 | | 12/2002 | Duhack |
| 2002/0189983 | A1 | | 12/2002 | Guess et al. |

OTHER PUBLICATIONS

Whirlpool Water Dispenser Literature for Appliance Models 106.70102000 and 106.70104000.

* cited by examiner

*Primary Examiner*—William E Tapolcai
(74) *Attorney, Agent, or Firm*—Diederiks & Whitelaw, PLC

(57) ABSTRACT

An internal water dispenser for a bottom mount refrigerator is located on an interior side wall of a fresh food compartment. The interior side wall is preferably opposite a hinge side of a door for the fresh food compartment and the dispenser is positioned forward of shelves arranged in the fresh food compartment such that the dispenser is arranged to be readily accessible to the consumer upon initially opening the fresh food door.

16 Claims, 2 Drawing Sheets

REFRIGERATOR WITH INTERNAL WATER DISPENSER

BACKGROUND OF THE INVENTION

1. Field of the Invention

The present invention pertains to the art of refrigerators and, more particularly, to an internal water dispenser arrangement provided in a fresh food compartment of a bottom mount style refrigerator.

2. Discussion of the Prior Art

Various styles of refrigerators are available on the market today. The most common styles include side-by-side, top mount and bottom mount refrigerators. A side-by-side refrigerator is characterized as having a freezer compartment which is located laterally adjacent a fresh food compartment; a top mount refrigerator includes a freezer compartment arranged vertically above a fresh food compartment; and a bottom mount refrigerator has a fresh food compartment disposed above a freezer compartment. In each of these styles of refrigerator, it is known to provide an ice and/or water dispenser that is directly accessible from outside of the refrigerator. Certainly, given the difference in temperatures of the fresh food and freezer compartments, it is intuitive to dispense ice from the freezer side and water from the fresh food side. However, it is typical to provide only a single dispenser arranged in the freezer door for a side-by-side refrigerator or in the fresh food door for a top mount style refrigerator. In general, bottom mount refrigerators are restricted to water dispensers in the fresh food door.

Regardless of the type of refrigerator, providing an external dispenser means that the water line must be routed into one of the refrigerator doors, wherein the water in the line is subjected to somewhat higher temperatures. This arrangement results in water being dispensed at temperatures at least slightly greater than potentially available. To this end, there is a need to locate a refrigerator water dispenser in a non-obtrusive, yet readily accessible, position within a fresh food compartment of a refrigerator in order to enable the dispensing of water at a lower temperature. More specifically, there is considered to be a particular need for a water dispenser in a side wall of the fresh food compartment of a bottom mount refrigerator wherein water can be dispensed at an optimal temperature and vertical position from the bottom mount refrigerator.

SUMMARY OF THE INVENTION

The present invention is directed to an internal water dispenser for a bottom mount refrigerator. More specifically, a dispenser for cold, potable water is located on an interior side wall of a fresh food compartment of a bottom mount refrigerator. The interior side wall is preferably opposite a hinge side of a door for the fresh food compartment such that the dispenser is arranged to be readily accessible to the consumer upon initially opening the fresh food door.

In accordance with a preferred embodiment of the invention, a water line is connected to a supply system in a lower rear machine compartment of the refrigerator. Water flows through a replaceable filter cartridge which is also accessible from within the fresh food compartment and then to a cold water reservoir located behind storage drawers provided in the fresh food compartment. Water is routed from the reservoir to the dispenser through a conduit located along, and preferably directly behind, the side wall of the fresh food compartment. Dispensing occurs when a consumer causes a button of the dispenser to be depressed, thereby opening a solenoid valve. Because the water is routed entirely within a cabinet of the refrigerator, the water dispensed is quite cold.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
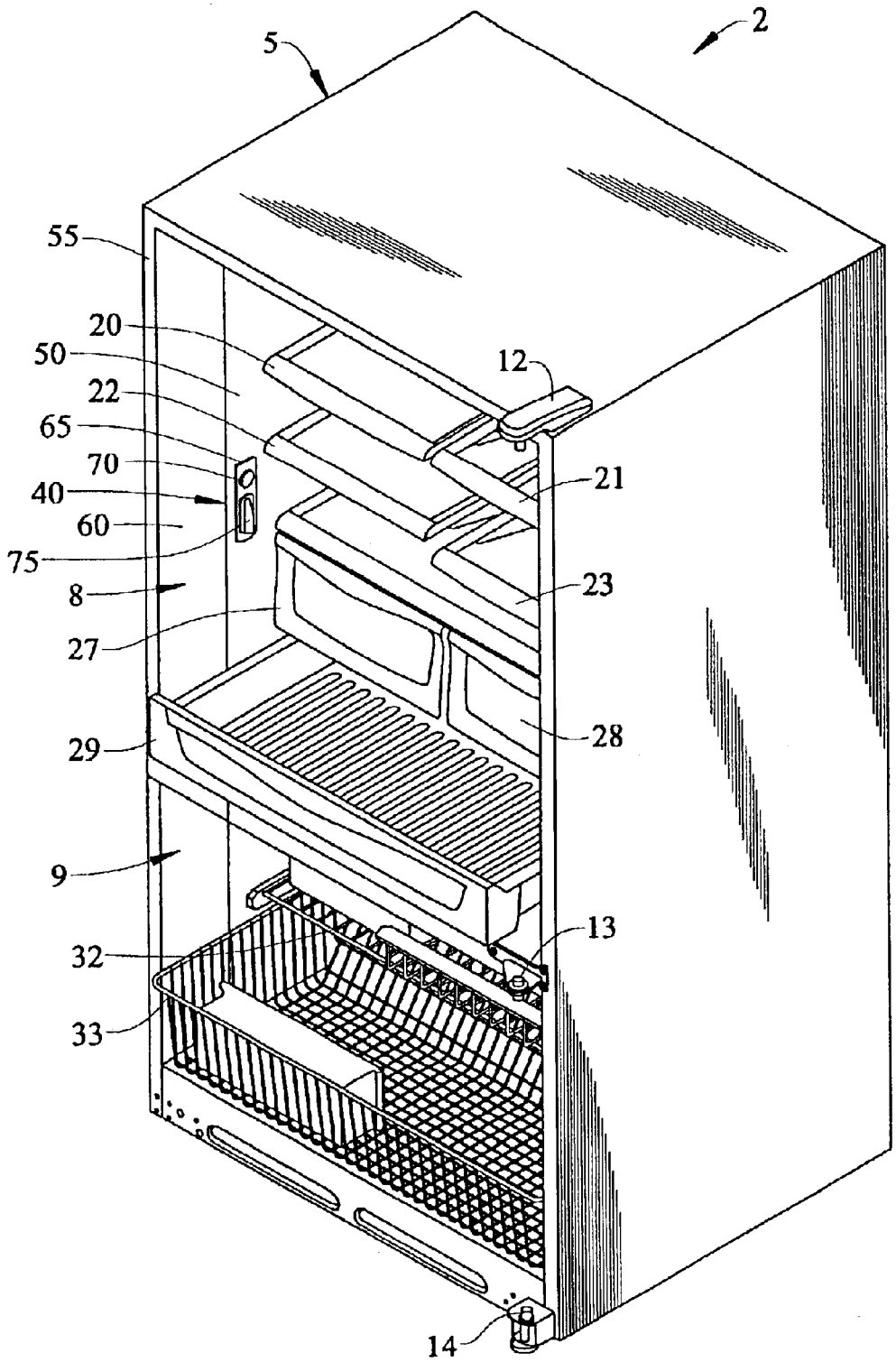
FIG. 1 is an upper right perspective view of a bottom mount refrigerator including a water dispenser arrangement in accordance with the present invention.

With initial reference to FIG. 1, a refrigerator associated with the present invention is generally indicated at 2. As shown, refrigerator 2 includes a cabinet 5 within which is defined an upper fresh food compartment 8 and a lower freezer compartment 9. Also depicted are upper, central and lower hinges 12–14 which are used in connection with pivotally mounting fresh food and freezer doors 16 and 18 of refrigerator 2 (also see FIG. 2). At this point, it should be realized that refrigerator 2 constitutes a bottom mount style refrigerator in which the present invention has particular advantages.

In the embodiment shown, fresh food compartment 8 includes a plurality of spaced shelves 20–23, as well as a plurality of storage drawers 27–29. Storage drawer 29 actually constitutes a crisper drawer which extends across substantially the entire width of fresh food compartment 8. On the other hand, freezer compartment 9 is shown to include upper and lower racks 32 and 33 for storing food items to be frozen. In any case, the present invention is particularly directed to the inclusion of an internal water dispenser 40 within fresh food compartment 8 and, more particularly, to the inclusion of water dispenser 40 on a side wall 50 opposite hinges 12–14 of cabinet 5.

As clearly illustrated in FIG. 1, water dispenser 40 is recessed relative to a front edge 55 of cabinet 5, but in front of shelving 20 and 22, as well as drawer 27. Actually, in the most preferred embodiment of the invention, dispenser 40 is arranged vertically between shelf 22 and drawer 27. In this position on side wall 50, dispenser 40 will not obstruct the closing of fresh food compartment door 16 as it is located rearward of a forward most, tapering side wall section 60, while even large containers can be filled with water through dispenser 40 in front of drawer 27. In any case, in the preferred embodiment shown, dispenser 40 includes a base plate 65, an actuator button 70, and a laterally projecting and downwardly opening water delivery spout 75.

Figure 2:
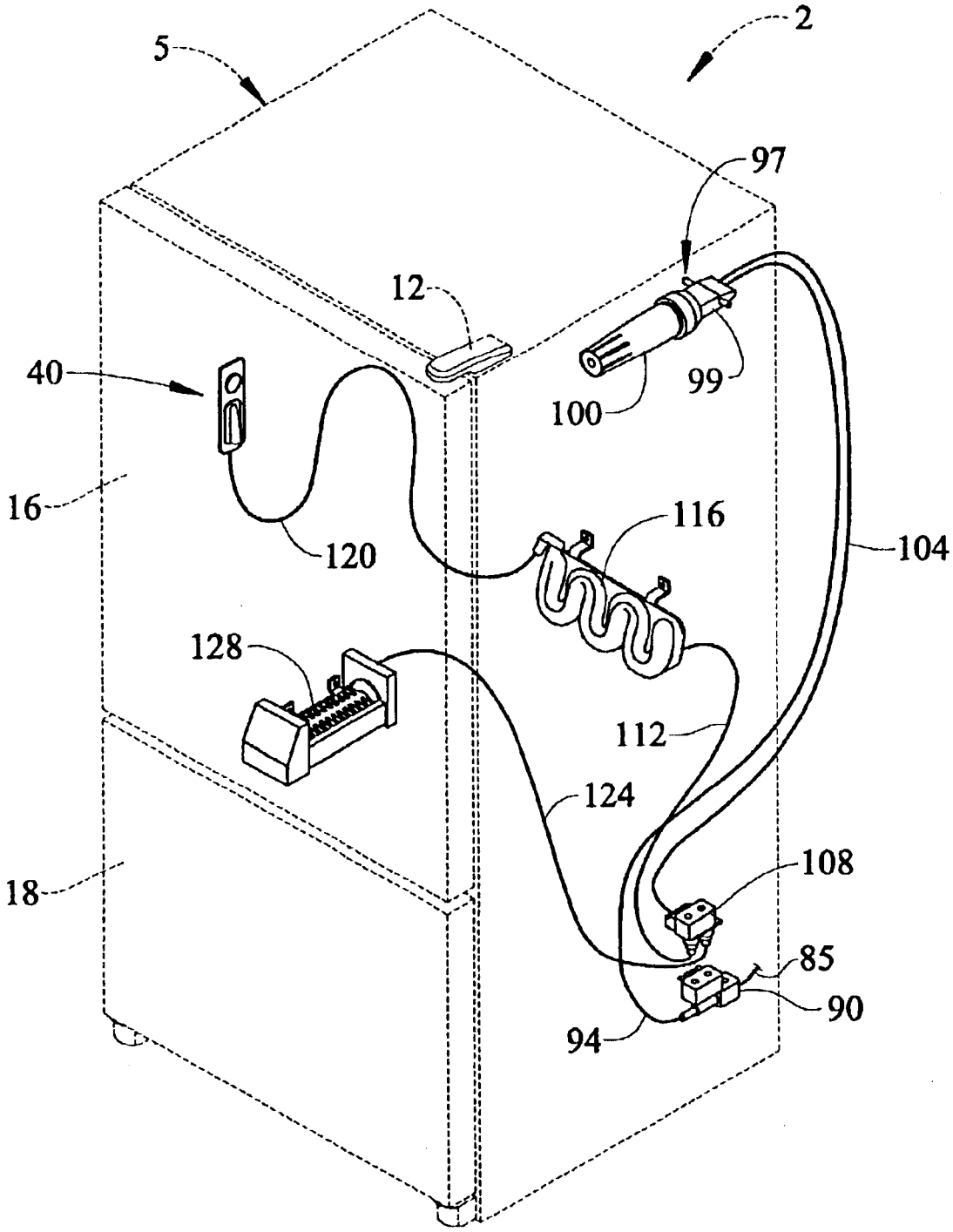
FIG. 2 is another perspective view of the refrigerator of FIG. 1, schematically depicting an overall water flow system employed in connection with the water dispenser of the invention.

FIG. 2 best shows the inclusion of dispenser 40 in connection with an overall water flow system for refrigerator 2. In this preferred embodiment, a water supply line, which is partially shown at 85, is used to deliver water to a first solenoid valve 90. Solenoid valve 90 includes an outlet conduit 94 which leads to a filter unit 97. Filter unit 97 can take various forms known in the art, but preferably includes a fixed base 99 and a replaceable filter cartridge 100 which is exposed within an upper rear portion of fresh food compartment 8. Filter unit 97 has associated therewith a filtered water supply line 104 which directs filtered water to a second solenoid valve 108. As shown, first and second solenoid valves 90 and 108 are preferably located adjacent each other and, more specifically, within a lower rear machine compartment of refrigerator 2 which, in a manner known in the art, houses a compressor (not shown) and other components of an overall refrigeration system employed to cool fresh food and freezer compartments 8 and 9. Since this overall cooling arrangement is not part of the present invention, it will not be further discussed herein. As shown, second solenoid valve 108 includes a first output line 112 which leads to a serpentine water reservoir 116. Although the particular location of reservoir 116 can vary, the most preferred embodiment positions reservoir 116 behind storage drawers 27 and 28 in a lower rear portion of fresh food compartment 8. An outlet side of reservoir 116 has connected thereto a delivery conduit 120 which directs the filtered water to dispenser 40.

Second solenoid valve 108 also has associated therewith a second output line 124 which is used to direct filtered water to an ice maker 128 provided within freezer compartment 9. In general, this manner of employing multiple solenoids, a filter unit and a reservoir for storing water in connection with a refrigerator is known in the art, such as disclosed in U.S. Patent No. 5,135,645 which is incorporated herein by reference, such that this general arrangement is simply presented for the sake of completeness. However, in accordance with the invention, it is important to note that the filtered water flow path to reservoir 116 and through delivery conduit 120 to dispenser 40 can remain entirely within fresh food compartment 8, or at least within cabinet 5, such that the filtered water delivered through dispenser 40 can be at a substantially reduced temperature as compared to providing a dispenser within fresh food compartment door 16 wherein a delivery conduit, corresponding to delivery conduit 120, would have to be routed into an insulated area with-in fresh food compartment door 16 and would inherently be subjected to warmer temperatures. In addition, significant cost savings are achieved by not having to route a delivery conduit through a door hinge. By providing dispenser 40 on a side opposite hinges 12–14 as employed in accordance with one preferred form of the invention, only a partial opening of fresh food compartment door 16 is required to enable water to be readily dispensed within a wide range of different sized containers. It should also be noted that, in accordance with the preferred embodiment shown, there is no recess or well associated with dispenser 40 such that even extremely elongated containers can be readily positioned beneath delivery spout 75 for filling purposes. Furthermore, it should be understood that providing internal water dispenser 40 in connection with bottom mount refrigerator 2 is considered to be extremely advantageous given the overall height of fresh food compartment 8 based on the location of freezer compartment 9 there beneath. Therefore, water dispenser 40 can be provided at an optimum height for easy access and use, as opposed to providing such a dispenser in a top mount refrigerator wherein dispensing water therefrom would typically require a user to bend over and/or have a somewhat obstructed view of the dispenser.

Although described with reference to a preferred embodiment of the invention, it should be readily understood that various changes and/or modifications can be made to the invention without departing from the spirit thereof. For instance, although water dispenser 40 is shown to include an actuator button 70 located above delivery spout 75, it is possible to employ an actuator arranged below delivery spout 75 wherein the actuator can be engaged by a container to be filled. In addition, although water dispenser 40 is preferably on side wall 50 opposite hinges 12–14, water dispenser 40 could be arranged on the opposing fresh food liner side wall (not shown). In general, the invention is only intended to be limited by the scope of the following claims.

What is claimed is:

1. A refrigerator comprising:

a cabinet within which is defined a fresh food compartment and a freezer compartment, said fresh food compartment being located above the freezer compartment and including a first side wall and an opposing, second side wall;

a fresh food compartment door pivotally mounted to the cabinet along the second side wall of the fresh food compartment;

a plurality of shelves arranged in the fresh food compartment; and a water dispenser arranged on the first side wall of the fresh food compartment.

2. The refrigerator according to claim 1, wherein the water dispenser is located forward of the plurality of shelves.

3. The refrigerator according to claim 2, wherein the first side wall includes a tapering portion, said water dispenser being located rearward of the tapering portion.

4. The refrigerator according to claim 2, wherein the water dispenser includes a water spout projecting from the first side wall toward the second side wall.

5. The refrigerator according to claim 4, wherein the water dispenser also includes an actuator for controlling a flow of water from the water dispenser.

6. The refrigerator according to claim 5, wherein the actuator is located above the water spout.

7. The refrigerator according to claim 6, wherein the water dispenser further includes a base plate mounted against the first side wall of the fresh food compartment.

8. The refrigerator according to claim 1, further comprising:

a water reservoir mounted in the fresh food compartment; and a delivery conduit leading from the reservoir to the water dispenser, said delivery conduit extending entirely within the cabinet.

9. In a refrigerator including freezer and fresh food doors mounted to a cabinet for selectively, respectively accessing a lower freezer compartment and an upper fresh food compartment defined within the cabinet, a dispenser for delivering water from within the upper fresh food compartment comprising:

a water spout projecting from an inner side wall of the fresh food compartment; and an actuator for controlling a flow of water from the water dispenser.

10. The dispenser according to claim 9, wherein the actuator is arranged above the water spout on the inner side wall.

11. The dispenser according to claim 9, wherein the inner side wall includes a tapering portion, said water dispenser being located rearward of the tapering portion.

12. The dispenser according to claim 9, wherein the water dispenser further includes a base plate mounted against the inner side wall of the upper fresh food compartment.

13. The dispenser according to claim 9, further comprising:

a water reservoir mounted in the upper fresh food compartment; and a delivery conduit leading from the reservoir, said delivery conduit extending entirely within the cabins.

14. A method of dispensing water from a refrigerator including freezer and fresh food doors mounted to a cabinet for selectively, respectively accessing a lower freezer compartment and an upper fresh food compartment defined within the cabinet comprising:

opening the fresh food door;

operating an actuator; and collecting water discharged from a dispenser projecting from an inner side wall of the upper fresh food compartment.

15. The method or claim 14, wherein the water is collected forward of a plurality of shelves mounted in the upper fresh food compartment.

16. The method of claim 15, further comprising:

directing water to a water reservoir mounted in the upper fresh food compartment; and delivering water from the reservoir to the water dispenser though a conduit extending entirely within the cabinet.

* * * * *